United States Patent [19]

Myers

[11] Patent Number: 4,864,994

[45] Date of Patent: Sep. 12, 1989

[54] ENGINE OVERRIDE CONTROLS

[75] Inventor: H. Allen Myers, Ames, Iowa

[73] Assignee: Sundstrand Corporation, Rockford, Ill.

[21] Appl. No.: 322,181

[22] Filed: Nov. 16, 1981

[51] Int. Cl.[4] ..... F02M 39/00

[52] U.S. Cl. ..... 123/386; 123/365; 414/699; 60/431

[58] Field of Search ..... 123/386, 385, 388, 365; 414/699; 60/431, 445, 420

[56] References Cited

U.S. PATENT DOCUMENTS

| | | | |
|---|---|---|---|
| 2,941,365 | 6/1960 | Carlson et al. | 60/52 |
| 2,942,421 | 6/1960 | Hann et al. | 60/52 |
| 3,159,965 | 12/1964 | Woolley et al. | 60/19 |
| 3,447,556 | 6/1969 | Howeth | 137/112 |
| 3,703,806 | 11/1972 | Williamson | 60/19 |
| 3,812,676 | 5/1974 | Smith | 60/431 |
| 3,866,418 | 2/1975 | Waters | 60/420 |
| 3,949,713 | 4/1976 | Rivere | 123/458 |
| 3,987,625 | 10/1976 | Swatty et al. | 60/431 |
| 4,373,850 | 2/1983 | Durham | 123/386 |

FOREIGN PATENT DOCUMENTS 2751663 5/1978 Fed. Rep. of Germany .

OTHER PUBLICATIONS

Specification Sheet No. 55, Viatran Corporation 8/78.

*Primary Examiner*—Carl Stuart Miller

*Attorney, Agent, or Firm*—Wood,Dalton,Phillips Mason & Rowe

[57] ABSTRACT

An engine override control for an engine (10) which drives a vehicle transmission (18) and an auxiliary variable displacement pump (20) and which is operable to increase engine speed beyond a set engine speed command to increase flow from the auxiliary pump which has reached maximum displacement at said set engine speed under the control of flow-compensator control (60). A valve (31) controls the delivery of fluid from the pump to a load (34) and associated orifices (42*a*) and (43*a*) establish a pressure differential between the pressure of fluid supplied by the auxiliary pump (20) and the operating pressure applied to the load. A cylinder (80) responsive to the pressure differential acts on a control member (12) for the engine governor to increase the speed of the engine when the pressure differential falls below a predetermined value.

6 Claims, 2 Drawing Sheets

INCREASE SPEED
ENGINE SPEED COMMAND
VEHICLE TRANSMISSION
GOV.
ENGINE
12
25
18
17
26
82
81
80
83
11
16
15
10
21
22
20
85
72
71
60
62
67
65
30
63
64
61
66
70
32
35'
34
35
36'
36
31
40
42a
41
42
44
43
43a
51
33
44'
45'
51'
75
45
46
50
77
76

ENGINE OVERRIDE CONTROLS

TECHNICAL FIELD

This invention relates to engine override controls operable to override an engine speed command when flow demand from a pump driven by the engine exceeds the available pump output at the commanded speed of the engine and, more particularly, to override control of an engine which powers a vehicle drive transmission and an auxiliary pump and the override control being operable when demand on the auxiliary pump exceeds the output thereof.

BACKGROUND ART

It is known in the art to have an engine power a vehicle drive transmission and also an auxiliary pump in an auxiliary hydraulic circuit. When the engine is at idle, such as when the vehicle is stationary, there can be operation of the auxiliary hydraulic system and, at the time of such operation, the engine speed is caused to increase. Controls for increasing engine speed have included mechanism operable simultaneously with manual operation of a valve in the auxiliary hydraulic circuit and systems which respond to pressure within the auxiliary hydraulic circuit.

DISCLOSURE OF THE INVENTION

The present invention relates to a control for an engine which drives mechanism including an auxiliary pump operable to supply fluid to a load and which detects when flow demand on the auxiliary pump exceeds pump flow at a particular speed setting for the engine and increases the engine speed to increase pump output.

An object of the invention is to provide a control for an engine which drives mechanism including an auxiliary pump comprising, means for detecting when flow demand on said auxiliary pump exceeds pump flow, and means for increasing the speed of the engine above a previously-set speed when flow demand exceeds pump output.

Another object of the invention is to provide an engine governor override control for an engine which drives a vehicle transmission and an auxiliary pump operable to supply fluid to a plurality of auxiliary loads comprising, means for establishing a pressure differential between the pressure of fluid supplied by the auxiliary pump and the highest operating pressure applied to one of said auxiliary loads, and means for adjusting the governor to increase the speed of the engine when the pressure differential between the supply pressure and the highest operating pressure falls below a predetermined value.

Another object of the invention is to provide an override control of the type set forth in the preceding paragraph wherein the auxiliary pump is a variable displacement pump and has a flow-compensator control operable to increase pump displacement up to maximum displacement when said pressure differential falls below said predetermined value.

Another object of the invention is to provide a control, as set forth in the preceding paragraphs wherein the means for adjusting the governor includes a cylinder having a piston with a rod extending therefrom to a position adjacent a control member for the governor, means urging said rod into contact with said control member, means for applying the pressure of fluid supplied by the pump to said cylinder in a manner to urge the rod away from the member, and means for applying the highest operating pressure to the cylinder to provide a force additive to that of said urging means.

Another object of the invention is to provide for adjustment of the governor in response to said pressure differential by means including sensor means for sensing the pressure differential and outputting a signal proportional thereto, an override control which receives said proportional signal and outputs an override signal when said proportional signal is below a predetermined value, driving means for moving an actuator for the governor, and a summing device which sums an engine speed command and said override signal and controls the driving means for the governor actuator.

Still another object of the invention is to provide an engine governor override control for an engine operable to increase engine speed beyond a set engine speed command to increase flow from the variable displacement pump driven by the engine comprising, a flow-compensator control for controlling displacement of said pump in response to a fluid pressure differential, a valve for controlling the delivery of fluid from the pump to a load, means for sensing a pressure differential between the pressure of fluid supplied by the pump and the operating pressure applied to the load, means for applying said pressure differential to said flow-compensator control to set said pump displacement to maintain said pressure differential, and means including an engine override actuator operable to increase engine speed in response to said pressure differential dropping below a predetermined value when said pump is at maximum displacement.

BEST MODES FOR CARRYING-OUT THE INVENTION

Figure 1:
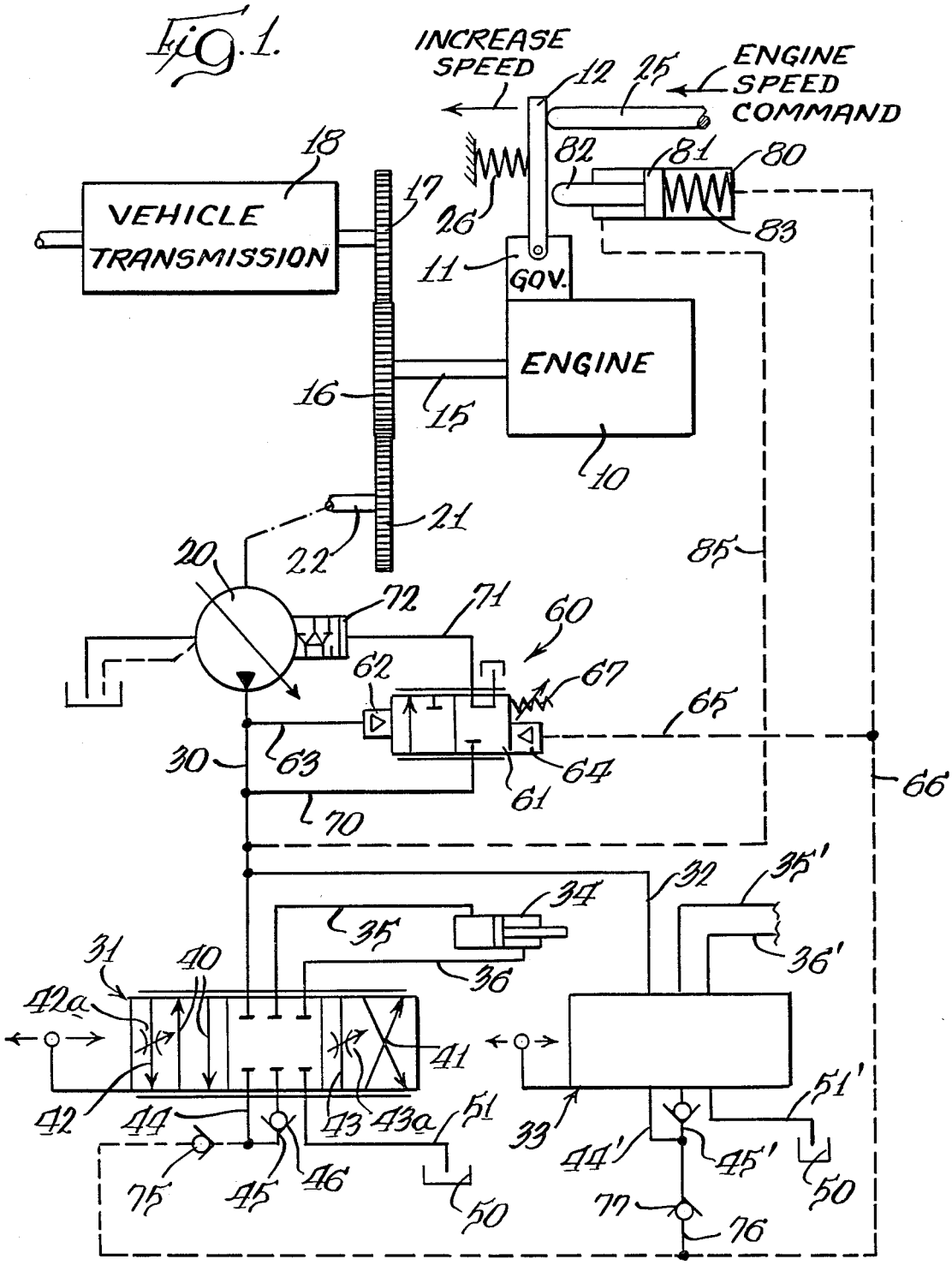
FIG. 1 is a schematic drawing of one embodiment of the engine override control.

The control in the embodiment of FIG. 1 is associated with an engine 10, such as an internal combustion engine, which has its speed established by the setting of a governor. The governor is set by positioning of a control member 12 associated therewith. The engine 10 has an output shaft 15 which, through gearing diagrammatically indicated and including a gear 16, drives an input gear 17 to a vehicle transmission 18 which can be a mechanical transmission or a hydraulic transmission, such as a hydrostatic transmission. The engine 10 also drives an auxiliary pump 20 by means of a drive input gear 21 on an input drive shaft 22 for the auxiliary pump meshing with the gear 16.

The auxiliary pump 20 is a variable displacement pump, such as an axial piston pump, having a variable position swashplate and with the angle of the swashplate setting the stroke of the pistons of the pump and, therefore, the rate of flow from the pump at any one particular engine speed. The output of the auxiliary pump is connected by fluid circuits to plural, selectively-operable loads, such as cylinders used to operate dozer blades, lift buckets and the like associated with the vehicle.

It is desirable to control the engine and also the vehicle transmission in a manner which gives the operator control of vehicle speed while keeping engine speed at the minimum required to provide sufficient power for the vehicle drive. Engine speed is set by inputting an engine speed command to the governor 11 through a member 25, which can be manually positioned or remotely-operated, to engage the control member 12 and move the control member 12 in a counterclockwise direction (FIG. 1) against the action of a spring 26 to move the governor 11 in a direction to increase engine speed. The control member 12 is caused to follow the position of the member 25 under urging of the spring 26 whereby movement of the member 25 toward the right results in a reduction in engine speed.

It is possible that an operating situation will occur where no vehicle speed is desired which allows the engine to operate at a low speed but flow from the auxiliary pump 20 is desired which is in excess of that available when the pump is at maximum displacement and driven by the engine at low speed. The override control associated with the auxiliary pump and the engine governor 11 provides for increase of engine speed when flow demand to one or more loads, supplied by the auxiliary pump, exceeds the pump output.

The auxiliary pump 20 has an outlet connected to a fluid supply line 30 which extends to a directional valve 31 and through a branch supply line 32 to a directional valve 33. These valves have continuous positioning capability. The directional valve 31 controls the operation of a load, such as a cylinder 34 for operating an implement associated with the vehicle. The directional valve 31 is connected to opposite ends of the cylinder 34 through the cylinder lines 35 and 36. The directional valve 31 is a closed center valve and, as shown in the neutral center position, the fluid supply line 30 as well as lines 35 and 36 extending to the cylinder 34 are blocked. The directional valve can be shifted to either side of the neutral center position for connecting one of the pair of cylinder lines 35 and 36 to the fluid supply line 30 and connecting the other of said pair of lines to tank, with these conditions being indicated by the diagrammatically-shown parallel flow lines 40 and crossed flow lines 41. It will be noted that the flow lines 40 and 41 do not directly connect the fluid supply line 30 with the cylinder lines 35 and 36. The directional valve has an additional pair of flow paths, indicated diagrammatically by flow lines 42 and 43, which have adjustable orifices **42*a* and 43*a*, respectively, therein, and which, in either operative position of the directional valve, function to connect the fluid supply line 30 to a fluid passage 44 which communicates with a fluid passage 45 having a check valve 46. Fluid supplied by the auxiliary pump 20 reaches either the cylinder lines 35 and 36 when the directional valve is shifted from center neutral position by flow through fluid passages 44 and 46 to reach one of the cylinder lines and with the other cylinder line being connected to tank 50 through a line 51**.

The directional valve 33 is of the same construction as the directional valve 31 and is operable to supply fluid under pressure to a second motor, such as a cylinder, through the cylinder lines corresponding to lines 35 and 36 and identified at 35' and 36' and with the fluid passages which direct fluid through the valve from the branch supply line 32 to one of the cylinder lines being indicated at 44' and 45'. The tank line is identified at 51' and extends to tank 50.

Manual or remote operation of one or both of the directional valves 33 as well as additional directional valves associated with additional loads provides for delivery of fluid from the auxiliary pump to the operated load at an operating pressure.

Whichever of the orifices **42*a* or 43*a* of a directional valve is in circuit to deliver fluid from the auxiliary pump to the load is effective to create a pressure differential between auxiliary pump supply pressure which is the pressure in supply line 30 and an operating pressure which exists in one of the pair of cylinder lines 35 and 36**.

The variable displacement pump 20 has a flow-compensator control associated therewith which functions to increase the displacement setting and flow from the pump when flow demand to one or more of the loads exceeds the pump output at a particular displacement setting, less than maximum, and engine speed. The flow-compensator control is indicated generally at 60 and has a valve 61 positionable in response to a pressure differential. The pressure differential is that between supply pressure which is applied to a pilot 62 for the compensator control valve through a line 63 connected to the pump outlet line 30 and the operating pressure applied to a load which is applied to a pilot 64 through a line 65 connected to a fluid line 66.

The swashplate of the auxiliary pump 20 is normally urged toward a position of maximum displacement by structure within the pump and when the pressure differential exceeds the force of the valve spring 67 the compensator control valve 61 modulates the supply of pump outlet fluid from a line 70, extending from the supply line 30, to a line 71, extending to a servo cylinder 72 for the pump, to exert a force in opposition to the displacement-setting forces within the pump and set a pump displacement to provide the necessary flow to maintain the pressure differential. When the pressure differential drops, and the spring 67 is effective to urge the valve member toward the position shown in FIG. 1, the line 71 extending to the servo cylinder 72 for the pump is connected to tank to reduce the pressure applied to the servo cylinder with resulting increase in displacement of the pump.

The operating pressure applied to the pilot 64 of the flow-compensator control is derived from the fluid line 66 which has fluid at an operating pressure which is the highest of the operating pressures applied to the loads supplied with fluid from the auxiliary pump. The line 66 connects to the flow path lines 44 and 45 of the directional valve 31 through a check valve 75 and also connects to a line 76 having a check valve 77 which connects to the flow path lines 44' and 45' of the directional valve 33. The check valves 75 and 77 permit the higher of the operating pressures, when both directional valves are functioning to operate the associated loads, to exist in the fluid line 66 while such higher pressure is blocked from the other directional valve.

When the flow-compensator control 60 has the auxiliary pump at maximum displacement and the value of the pressure differential is below a predetermined value because the flow demand exceeds the pump output, the pressure differential acts at an engine governor override actuator 80 in the form of a cylinder having a piston 81 with a rod 82 extending to a position adjacent the control member 12. The rod 82 is urged toward the control member 12 by a spring 83 within the cylinder and acting against the piston 81. The supply pressure is applied to the cylinder 80 through a line 85 extending from the supply line 30 to act on the piston in opposition to the spring 83 while the higher of the operating pressures, which is less than supply pressure, is applied through the line 66 to the spring side of the cylinder. So long as the pressure differential exceeds the force of the spring 83, the governor override actuator is ineffective but, once the pressure differential is insufficient to overcome the urging of the spring 83 and the force of spring 26, the rod 82 can extend to engage the control member 12 and cause movement thereof in a direction to adjust the governor 11 and increase engine speed until the desired pressure differential is achieved.

With the control shown in FIG. 1, the speed of the engine is controlled to assure that the auxiliary pump provides adequate flow to meet the flow demand of one or more loads by detecting a pressure differential between supply pressure and the highest operating pressure for a load and responding to a decrease in the pressure differential below a predetermined value when the pump is at maximum displacement to increase the engine speed.

Figure 2:
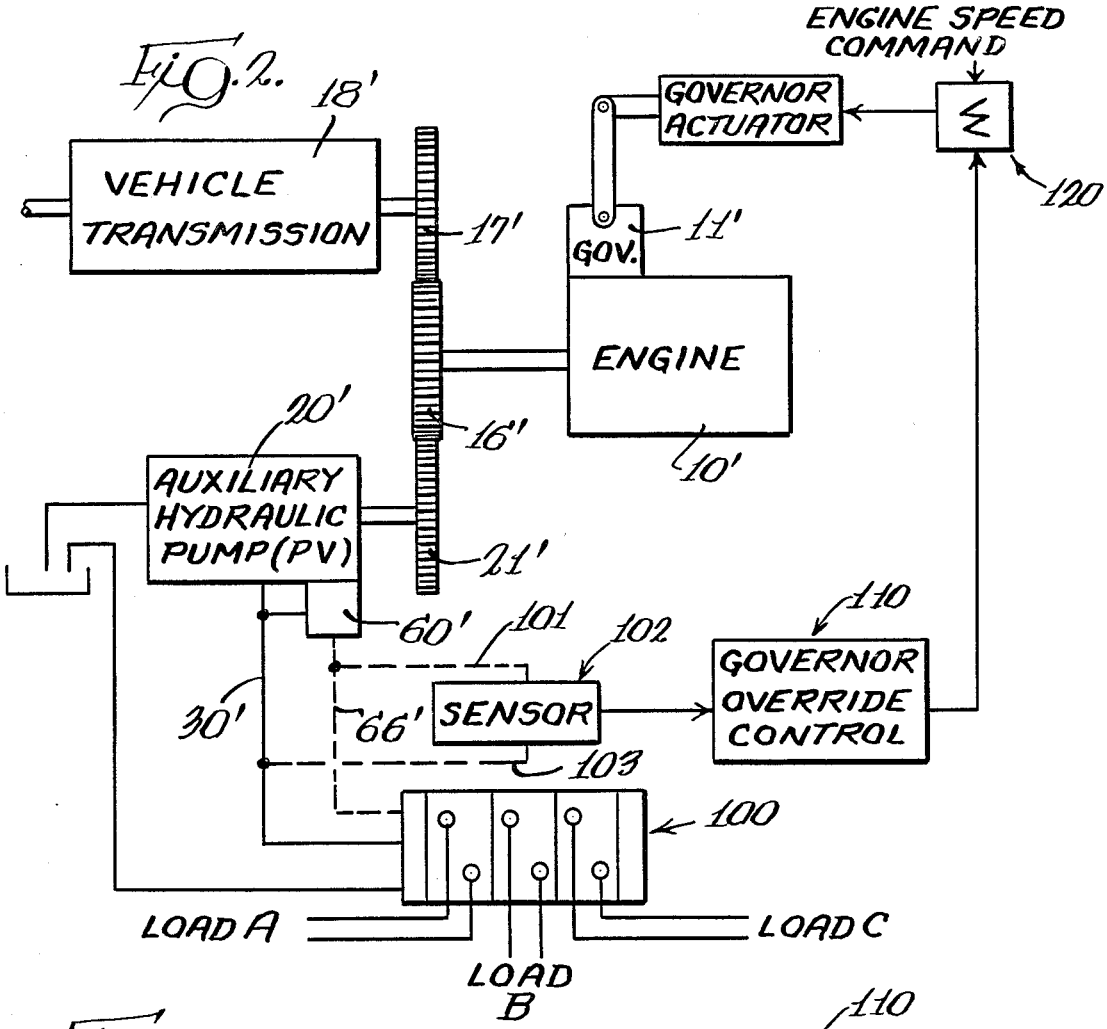
FIG. 2 is a schematic drawing of an alternate embodiment of the engine override control.
Figure 3:
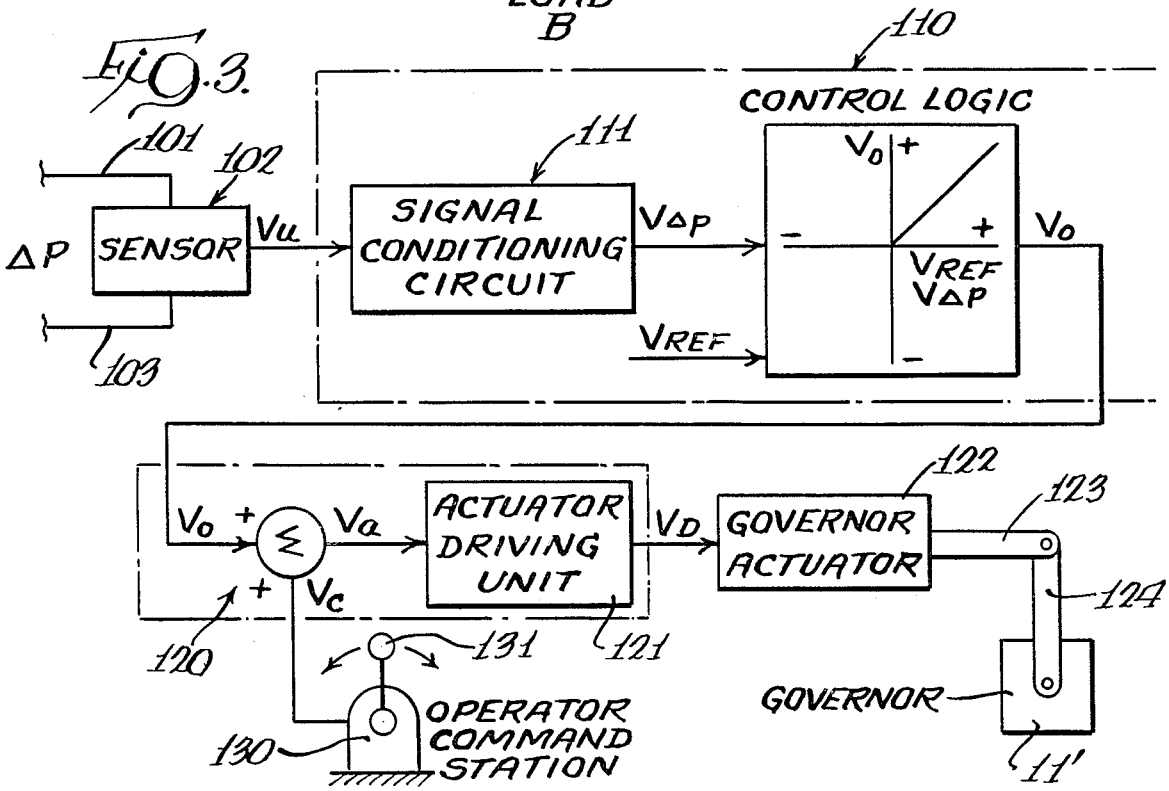
FIG. 3 is a circuit block diagram of a part of the control shown in FIG. 2.

In the override control embodiment of FIGS. 2 and 3, the control is associated with the same basic components as FIG. 1 and have been given the same reference numeral, with a prime affixed thereto. An engine 10', having its speed controlled by a governor 11', drives a vehicle transmission 18' as well as an auxiliary variable displacement hydraulic pump 20' through gearing including gears 16', 17', and 21'. The auxiliary pump 20' has a flow-compensator control 60' which is load-sensing, as is the flow-compensator control in the embodiment of FIG. 1. A supply line 30' from the auxiliary pump supplies plural directional valves. Three of these valves are indicated diagrammatically at 100, with each having the structure of the directional valve 31 in the embodiment of FIG. 1. The directional valves are operable individually, or more than one at a time to control the delivery of fluid to plural loads, identified as loads A, B, and C. The valves are interconnected similarly to the embodiment of FIG. 1 to output the highest operating pressure to a line 66'.

The highest of the operating pressures applied to a load is delivered by the line 66' to the flow-compensator control 60' and through a fluid line 101 to a pressure differential sensor, indicated generally at 102, which also senses supply pressure through a fluid line 103 connected to the supply line 30'. The sensor 102 responds to the two pressures applied thereto, namely, supply pressure and the highest operating pressure, and, as shown in FIG. 3, provides an electrical output signal $V_u$, proportional to the difference between the supply pressure and the operating pressure to a governor override control, indicated generally at 110. The sensor 102 can be a commercially available pressure differential transducer and an example of such transducer is Model 220 Pressure Transducer offered by Viatran Corporation of Grand Island, New York.

The governor override control 110 has a signal conditioning circuit, indicated generally at 111 and which, in a manner well known in the art, operates on the sensor signal, $V_u$, to provide a voltage, $V_{\Delta P}$, which is a conditioned signal representative of the pressure differential sensed by the pressure transducer. A control logic circuit compares the voltage $V_{\Delta P}$ to a reference voltage $V_{REF}$ representing a value wherein, when $V_{\Delta P}$ falls below said value an override signal $V_o$ is generated which is a voltage proportional to the difference between $V_{REF}$ and $V_{\Delta P}$ and is output to a summing device, indicated generally at 120. The summing device 120 includes an actuator driving unit 121 for control of a governor actuator 122 which is connected by links 123 and 124 to the governor 11'. The actuator driving unit sends an actuator driving signal $V_D$ to the governor actuator, which can be a suitable type of motor. The summing device 120 sums the override voltage $V_o$ with an operator's governor command voltage $V_c$ as input from a voltage generating unit 130 under the control of an operator as by a handle 131 to produce a signal $V_a$ indicating the required position of the governor actuator 122 and the governor 11'.

The circuitry shown in FIG. 3 causes an increase in governor setting for an increase in engine speed when $\Delta P$, sensed by the sensor 102 drops below a predetermined level, as set by $V_{REF}$. FIG. 3 discloses an electro-hydraulic type of pressure differential sensing and control structure and is given as an illustrative embodiment of the control, with it being understood that the control can be mechanical, hydraulic, electrical, or a combination of these, such as the electro-hydraulic type specifically disclosed.

INDUSTRIAL APPLICABILITY

With the engine override controls disclosed herein, it is possible to set an engine speed at the minimum speed required to provide sufficient power for the drive of a vehicle and, when auxiliary pump flow is required beyond that available at the set engine speed, the override control increases the engine speed to a level required to supply the desired auxiliary pump flow.

I claim:

1. An engine governor override control for an engine which drives a vehicle transmission and an auxiliary pump and operable to increase engine speed beyond a set engine speed command to increase flow from the auxiliary pump which is a variable displacement pump and which has reached maximum displacement at said set engine speed, said auxiliary pump being in a fluid circuit to supply fluid to a load at displacements less than maximum and said load having a maximum flow demand in excess of that which can be supplied by the pump when at maximum displacement, comprising, means for establishing and sensing a pressure differential between the pressure of fluid supplied by the pump and the operating pressure applied to a load to determine fluid flow rate, a flow-compensator control for said pump operable responsive to said pressure differential to increase pump displacement to maintain said pressure differential, and means responsive to a decrease in said pressure differential below a certain value to adjust said governor for an increase in the speed of the engine.

2. An engine override control in combination with an engine which powers a vehicle transmission and a variable displacement pump driven by the engine for supplying fluid to an auxiliary load, the pump being of a size to provide less than the maximum flow that can be demanded by the load when at maximum displacement and the engine is operating at a rate less than that which will drive the vehicle at normal speed comprising, means for measuring the rate of fluid flow to the auxiliary load, means responsive to the fluid flow rate to the auxiliary load for adjusting the displacement of the variable displacement pump to maintain the fluid flow rate including a flow-compensator control associated with the variable displacement pump, and additional means responsive to the fluid flow rate for increasing the speed of the engine when the variable displacement pump is at maximum displacement and the auxiliary load is demanding a greater flow of fluid than can be supplied by the pump.

3. An engine override control for an engine which powers a vehicle transmission and which also drives a variable displacement pump for supplying fluid to an auxiliary load and which is of a size to provide less than the maximum flow that can be demanded by the load when the engine is operating at a rate less than that which will drive the vehicle at normal speed comprising, means for measuring the rate of fluid flow to the auxiliary load including an orifice in a supply line to the auxiliary load and a pair of control lines connected to the supply line at opposite sides of the orifice, means responsive to the pressure differential in said control lines which is a measure of fluid flow rate to the auxiliary load for adjusting the displacement of the variable displacement pump to maintain the pressure differential including a flow-compensator control associated with the variable displacement pump, and additional means responsive to the pressure differential in said control lines for increasing the speed of the engine when the variable displacement pump is at maximum displacement and the pressure differential falls below a predetermined value.

4. A control for an engine operable to increase engine speed beyond a set engine speed command to increase flow from a variable displacement pump driven by the engine and for increasing pump displacement to a maximum prior to increasing engine speed, said pump being in a fluid circuit having a maximum flow demand in excess of that supplied by the pump when at maximum displacement, comprising, a flow-compensator control for controlling displacement of said pump in response to a fluid pressure differential, a directional valve for controlling the delivery of fluid from the pump to a load, means for establishing a pressure differential between the pressure of fluid supplied by the pump and the operating pressure applied to the load as a measure of the rate of fluid flow provided by the pump, means for applying said pressure differential to said flow-compensator control to adjust said pump displacement to maintain said pressure differential and increase pump displacement with a decrease in said pressure differential, and means including an engine override actuator operable to increase engine speed in response to said pressure differential dropping below a predetermined value when said variable displacement pump is at maximum displacement.

5. An override control as defined in claim 4 including a governor control member and wherein said engine override actuator includes a cylinder having a piston with a rod extending therefrom to a position adjacent said control member, means urging said rod into contact with said member, means for applying fluid supply pressure to said cylinder in a manner to urge the rod away from the member and means for applying the operating pressure to the cylinder to provide a force additive to that of said urging means.

6. A control as defined in claim 1 wherein said auxiliary pump can supply fluid to one or more loads, valve means for controlling supply of fluid to said loads, and said sensing means senses the differential pressure between the highest operating pressure and supply pressure.

* * * * *